US011780621B2

(12) United States Patent
Itagaki

(10) Patent No.: US 11,780,621 B2
(45) **Date of Patent: *Oct. 10, 2023**

(54) BRAKE SYSTEM OF WIRE REEL IN REINFORCING BAR BINDING MACHINE

(71) Applicant: MAX CO., LTD., Tokyo (JP)

(72) Inventor: Osamu Itagaki, Tokyo (JP)

(73) Assignee: MAX CO., LTD., Tokyo (JP)

( * ) Notice: Subject to any disclaimer, the term of this patent is extended or adjusted under 35 U.S.C. 154(b) by 662 days.

This patent is subject to a terminal disclaimer.

(21) Appl. No.: 16/564,950

(22) Filed: Sep. 9, 2019

(65) Prior Publication Data

US 2019/0389609 A1 Dec. 26, 2019

Related U.S. Application Data

(63) Continuation of application No. 16/106,768, filed on Aug. 21, 2018, now Pat. No. 10,457,428, which is a (Continued)

(30) Foreign Application Priority Data

May 19, 2008 (JP) ..... 2008-130641
May 19, 2008 (JP) ..... 2008-130646
Apr. 7, 2009 (JP) ..... 2009-092693

(51) Int. Cl.
*B65B 13/22* (2006.01)
*B65B 13/02* (2006.01)
(Continued)

(52) U.S. Cl.
CPC ..... *B65B 13/22* (2013.01); *B21F 15/04* (2013.01); *B65B 13/025* (2013.01); *B65H 59/04* (2013.01); *E04G 21/122* (2013.01); *E04G 21/123* (2013.01)

(58) Field of Classification Search
CPC ..... B21F 15/00; B21F 15/02; B21F 15/04; B21F 7/00; B25B 25/00; E04G 21/123;
(Continued)

(56) References Cited

U.S. PATENT DOCUMENTS 5,217,049 A 6/1993 Forsyth
5,342,000 A 8/1994 Berges et al.
(Continued)

FOREIGN PATENT DOCUMENTS

CN 86201247 U 8/1987
CN 1950578 A 4/2007
(Continued)

OTHER PUBLICATIONS

A Canadian Office Action dated Apr. 9, 2015 that issued in corresponding Canadian patent Application.
(Continued)

*Primary Examiner* — Bobby Yeonjin Kim
(74) *Attorney, Agent, or Firm* — Faegre Drinker Biddle & Reath LLP

(57) ABSTRACT

A reinforcing bar binding machine is provided with a feed means for feeding a wire from a wire reel rotatably mounted on a binding machine body, a braking means for braking a rotation of the wire reel, and a control means that starts a braking to the rotation of the wire reel by the braking means after the wire is fed to a predetermined amount by the feed means.

2 Claims, 14 Drawing Sheets

Related U.S. Application Data continuation of application No. 15/180,706, filed on Jun. 13, 2016, now Pat. No. 10,167,095, which is a continuation of application No. 15/059,942, filed on Mar. 3, 2016, now Pat. No. 9,399,875, which is a continuation of application No. 14/526,858, filed on Oct. 29, 2014, now Pat. No. 9,308,572, which is a continuation of application No. 14/276,066, filed on May 13, 2014, now Pat. No. 9,132,472, which is a continuation of application No. 12/467,459, filed on May 18, 2009, now Pat. No. 9,192,979.

(51) Int. Cl.
*E04G 21/12* (2006.01)
*B21F 15/04* (2006.01)
*B65H 59/04* (2006.01)

(58) Field of Classification Search
CPC ..... E04G 21/122; B65B 13/025; B65B 13/28; B65B 13/285; B65B 13/22; B65H 59/02; B65H 59/04; B65H 59/043
See application file for complete search history.

(56) References Cited

U.S. PATENT DOCUMENTS

| | | | | |
|---|---|---|---|---|
| 5,359,376 | A | 10/1994 | Ogihara et al. | |
| 5,558,134 | A | 9/1996 | Miyazaki | |
| 5,678,613 | A * | 10/1997 | Murayama | E04G 21/122 140/57 |
| 5,778,946 | A * | 7/1998 | Pellenc | A01G 17/085 140/119 |
| 6,000,443 | A * | 12/1999 | Hayashi | E04G 21/123 140/53 |
| 6,938,531 | B2 | 9/2005 | Yoshimizu et al. | |
| 7,866,597 | B2 | 1/2011 | Nagaoka et al. | |
| 7,950,421 | B2 * | 5/2011 | Nakagawa | E04G 21/123 140/119 |
| 8,636,038 | B2 | 1/2014 | Kusakari et al. | |
| 9,132,472 | B2 | 9/2015 | Itagaki | |
| 9,192,979 | B2 * | 11/2015 | Itagaki | B65B 13/22 |
| 9,221,566 | B2 | 12/2015 | Itagaki | |
| 9,308,572 | B2 | 4/2016 | Itagaki | |
| 9,399,875 | B2 | 7/2016 | Itagaki | |
| 9,856,041 | B2 | 1/2018 | Itagaki | |
| 10,167,095 | B2 | 1/2019 | Itagaki | |
| 2003/0029295 | A1 | 2/2003 | Yoshimizu et al. | |
| 2003/0145900 | A1 | 8/2003 | Jensen et al. | |
| 2006/0283516 | A1 * | 12/2006 | Nagaoka | E04G 21/123 140/119 |
| 2007/0227613 | A1 * | 10/2007 | Matsuoka | B65B 13/027 140/93.6 |
| 2008/0110354 | A1 * | 5/2008 | Itagaki | B65B 13/285 100/31 |
| 2008/0134908 | A1 * | 6/2008 | Nagaoka | B65B 13/027 100/2 |

FOREIGN PATENT DOCUMENTS

| | | | |
|---|---|---|---|
| CN | 201040930 | Y | 3/2008 |
| DE | 19603112 | A1 | 6/1996 |
| EP | 0908582 | A1 | 4/1999 |
| EP | 1900640 | A1 | 3/2008 |
| JP | H05-10208 | B2 | 2/1993 |
| JP | H5-173236 | A | 7/1993 |
| JP | H07-121937 | A | 5/1995 |
| JP | H11-104777 | A | 4/1999 |
| JP | H11-156743 | A | 6/1999 |
| JP | H11-156746 | A | 6/1999 |
| JP | H11-156747 | A | 6/1999 |
| JP | H11-156748 | A | 6/1999 |
| JP | H11-156749 | A | 6/1999 |
| JP | 2005-194847 | A | 7/2005 |
| RU | 2011451 | C1 | 4/1994 |
| SU | 1359046 | A1 | 12/1987 |
| TW | 251273 | B | 7/1995 |
| WO | WO-2004/083559 | A1 | 9/2004 |

OTHER PUBLICATIONS

Korean Office Action dated Jul. 20, 2016 in Korean Application No. 10-2016-0054415 with English language translation.

* cited by examiner

BRAKE SYSTEM OF WIRE REEL IN REINFORCING BAR BINDING MACHINE

BACKGROUND OF THE INVENTION

Field of the Invention

The present invention relates to a brake system of a wire reel which stops a rotation of a wire reel after a predetermined length of binding wire is fed, in a reinforcing bar binding machine.

Background Art

When a predetermined length of wire feed is performed in a reinforcing bar binding machine, wire feed is stopped, but a wire reel continues rotating by inertia. Therefore, the diameter of a wire wound around the wire reel may increase, and the next wire feed may be hindered. As a means for solving this, for example, like Patent Document 1 (JP-A-11-156746), the technique of a brake mechanism in which a hook-like brake lever (the same as a braking means of Patent Document 1) which is engageable with a wire reel is arranged in the vicinity of the wire reel, and the brake lever is actuated by a solenoid is disclosed. In addition, the brake mechanism of Patent Document 1 actuates the brake lever actuated by the solenoid so as to engage the peripheral edge of the wire reel, thereby stopping rotation of the wire reel, after the wire is fed by a predetermined length from the wire reel.

Meanwhile, in the brake mechanism of the reinforcing bar binding machine shown in FIG. 3 of Patent Document 1, with the configuration (including a spring) in which the brake lever rotate about a pivot, some time lag occurs until the brake operates after the solenoid is actuated. Additionally, for example, when a link mechanism (including a spring) is interposed between the brake lever, and the solenoid which actuates the brake lever, it is conceivable that time lag becomes still larger than that of FIG. 3 of Patent Document 1 described above. In addition, when the power of a battery used as a power source of the solenoid or the like is saved, the battery can be effectively used for a long time.

Moreover, in the reinforcing bar binding machine (includes Patent Document 1 or the like), the wire reel is exposed to the outside of a binding machine body in order to facilitate loading of the wire reel to the binding machine body. Additionally, the braking means and solenoid which are disposed in the vicinity of the wire reel are also exposed to the outside of the binding machine body. Therefore, when the reinforcing bar binding machine is used outdoors or the like, sand, a situation where dust, etc. adhere to the solenoid or the like and braking operation cannot be reliably performed is conceivable.

SUMMARY OF THE INVENTION

One or more embodiments of the invention provide a brake system of a wire reel and its braking processing method in a reinforcing bar binding machine capable of improving braking performance, and saving power.

In addition, one or more embodiments of the invention provide a brake mechanism of a wire reel in a reinforcing bar binding machine with improved dust-proofing performance of the brake mechanism.

In accordance with one or more embodiments of the invention, a reinforcing bar binding machine is provided with: a feed means 13, 14 for feeding a wire from a wire reel 20 rotatably mounted on a binding machine body 11; a braking means 30 for braking a rotation of the wire reel 20; and a control means 50 that starts a braking to the rotation of the wire reel 20 by the braking means 30 after the wire is fed to a predetermined amount by the feed means 13, 14.

Moreover, a braking by a braking means 30 to a rotation of a wire reel 20 is started after feeding a wire by a predetermined length from the wire reel 20 rotatably mounted on a binding machine body 11.

In the above configuration, since braking of the rotation of the wire reel is started by the braking means after the wire is fed by a predetermined amount of feed by the feed means, the time lag when braking is applied to the wire reel can be reduced, and braking performance improves.

Furthermore, in accordance with one or more embodiments of the invention, in a reinforcing bar binding machine in which a wire is fed from a wire reel 20 rotatably mounted on a binding machine body 11, the fed wire is wound around reinforcing bars, and the wound wire is twisted to bind the reinforcing bars, the reinforcing bar binding machine is provided with: a braking means 30 for braking a rotation of the wire reel 20; a counting means 50 for counting a number of times of binding by which the fed wire is twisted to bind the reinforcing bars; a recording means 52 for recording the number of times of binding; and a control means 50 for braking the rotation of the wire reel 20 by the braking means 30 only when the number of times of binding read from the recording means 52 is equal to or less than a predetermined number of times of binding.

In addition, in accordance with one or more embodiments of the invention, in a reinforcing bar binding machine in which a wire is fed from a wire reel 20 rotatably mounted on a binding machine body 11, the fed wire is wound around reinforcing bars, and the wound wire is twisted to bind the reinforcing bars, a braking processing of a wire reel is executed by: counting a number of times of binding by which the fed wire is twisted to bind the reinforcing bars; and braking a rotation of the wire reel 20 by a braking means 30, only when the number of times of binding is equal to or less than a predetermined number of times of binding.

In the above configuration, braking is applied to rotation of the wire reel by the braking means only if the number of times of binding by which the wire fed by a predetermined length by the feed means is twisted and bound is equal to or less than a reference value. That is, if the number of times of binding of a predetermined length of wire is a reference value or more, braking processing is omitted. Thus, power is saved, the service time of a power source of the feed means is extended, and the power source of the feed means can be effectively used for a long time.

Furthermore, in accordance with one or more embodiments of the invention, a reinforcing bar binding machine is provided with: a feed means 13, 14 for feeding a wire from a wire reel 20 rotatably mounted on a binding machine body 11; a braking means 30 for braking a rotation of the wire reel 20; a detecting means 57 for detecting a power voltage which starts the feed means 13, 14; and a control means 50 that makes a braking start time of the braking means 30 earlier than a reference time, only when the detected power voltage is a predetermined reference voltage or more.

Moreover, in accordance with one or more embodiments of the invention, a braking processing of a wire reel in a reinforcing bar binding machine is executed by: feeding a wire from a wire reel 20 rotatably mounted on a binding machine body 11 by a feeding means 13, 14; detecting a power voltage which starts the feed means 13, 14; and making earlier a braking start time of a braking means 30 for stopping a rotation of the wire reel 20 than a reference time, only when the detected power voltage is a predetermined reference voltage or more.

In the above configuration, if the power voltage of the feed means is a predetermined reference value or more, the feed rate of the wire becomes fast. Thus, if the timing with which braking is applied to the wire reel is not made earlier by the rate which becomes fast, the timing with which braking is applied becomes late on the contrary. That is, according to the invention, only if the power voltage of the feed means is a predetermined reference value or more, the braking start time of the stopper device which stops the rotation of the wire reel is made earlier than the reference time. Thus, braking is applied with proper timing, and braking performance improves.

On the other hand, if the power voltage of the feed means is lower than the reference value, the feed rate of the wire returns to a normal state. Thus, since the turn-on time of a power source of the feed means, for example, the solenoid becomes shorter than that when the power voltage of the feed means is a predetermined reference voltage or more. Thus, power is saved. That is, since the timing with which braking is applied is changed according to the power voltage of the feed means, the inertial rotation of the wire reel can be stopped reliably, and useless power consumption can be cut.

Further, in accordance with one or more embodiments of the invention, a reinforcing bar binding machine is provided with: a wire reel 20 rotatably mounted on abinding machine body 11; a braking means 30 engageable with an engaging portion 21 of the wire reel 20; a driving means 32, 60 for driving the braking means 30; and a cover for partitioning a portion between the driving means 32, 60 and the wire reel 20.

In the above configuration, a portion between the driving means and the wire reel is partitioned by a cover to conceal the driving means from the wire reel. Thus, even if the reinforcing bar binding machine is used outdoors or the like, braking operation can be reliably performed without adhesion of sand or the like to the driving portion. That is, the loading property of the wire reel is not impaired, and adhesion of sand or the like to the driving portion is prevented. Thus, dust-proofing performance improves.

Moreover, in accordance with one or more embodiments of the invention, a reinforcing bar binding machine is provided with: a braking means 30 engageable with an engaging portion 21 of a wire reel 20 rotatably mounted on a binding machine body 11; a driving means 32, 60 for driving the braking means 30; and a biasing means 36 which is hung on the braking means 30, and returns the braking means 30 to its initial position after the braking means 30 has engaged with the engaging portion 21. Further, the braking means may include a stopper lever 30 that is engageable with the engaging portion 21 of the wire reel 20. A first hooking portion 36B of the biasing means 36 may be locked to the binding machine body 11, and a second hooking portion 36C of the biasing means 36 may be locked to the stopper lever 30.

In the above configuration, the biasing means is directly hung on the braking means. Thus, the braking means can be directly returned to its initial state by the biasing force of the biasing means. That is, since there is no waste in the biasing force of the biasing means, and a useless force is not applied to each part, for example, a driving means. Thus, the braking means can be effectively returned.

Other aspects and advantages of the invention will be apparent from the following description, the drawings and the claims.

DESCRIPTION OF REFERENCE NUMERALS AND SIGNS

10: REINFORCING BAR BINDING MACHINE
11: BINDING MACHINE BODY
13: FEED GEARS (FEED MEANS)
14: FEED MOTOR (FEED MEANS)
16: TWISTING MOTOR
17: COVER (DUST-PROOFING MEANS)
21: ENGAGING PORTION OF WIRE REEL
24: REINFORCING BAR
30: STOPPER LEVER (BRAKING MEANS)
32: SOLENOID (BRAKING MEANS(DRIVING MEANS OF BREAKING MEANS))
34: SHAFT (DRIVING PORTION)
36: TORSION COIL SPRING (BIASING MEANS)
50: CPU (CONTROL MEANS OR COUNTING MEANS)
52: MEMORY (RECORDING MEANS)
53: BATTERY (POWER SOURCE OF FEED MEANS)
57: VOLTAGE DETECTING CIRCUIT (VOLTAGE DETECTING MEANS)
60: BRAKE MOTOR (DRIVING MEANS)
S: STOPPER DEVICE
W: WIRE

DETAILED DESCRIPTION OF THE EXEMPLARY EMBODIMENTS

Figure 1:
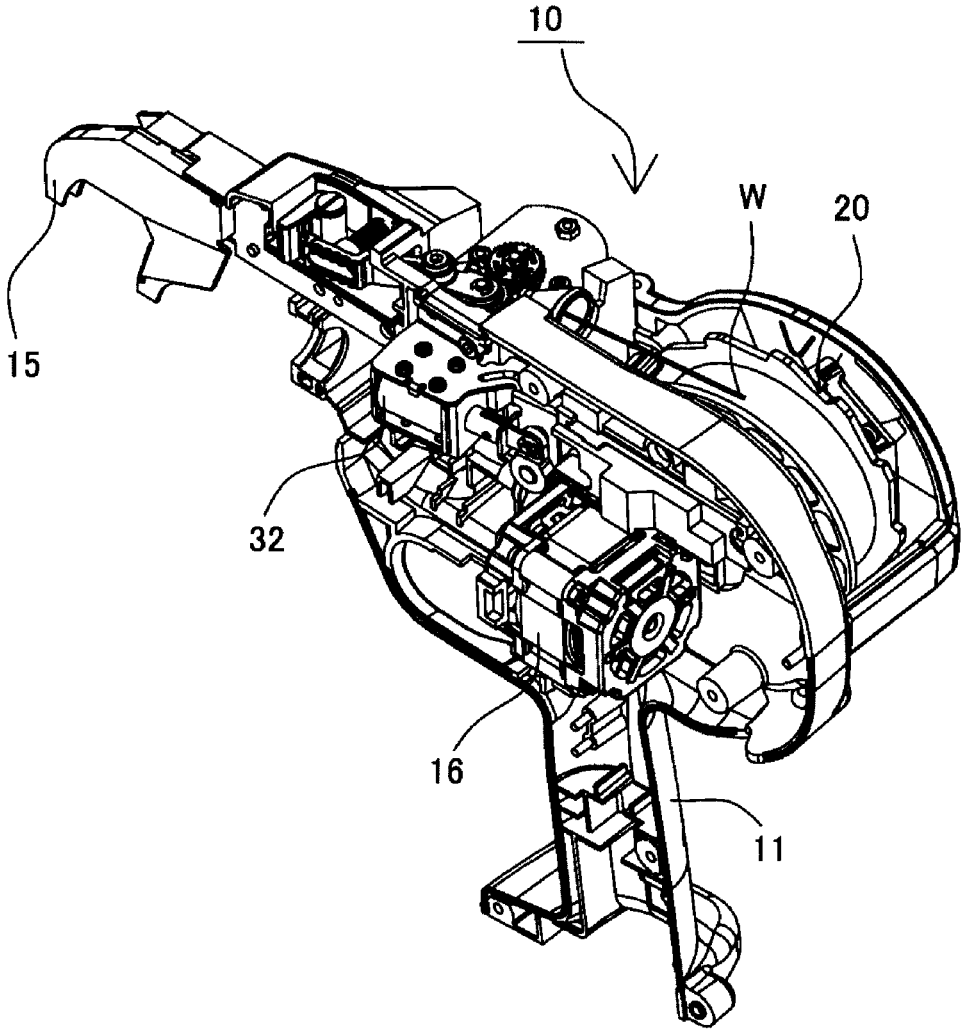
FIG. 1 is a whole perspective view showing essential portions of a reinforcing bar binding machine in a first embodiment related to the invention.
Figure 2:
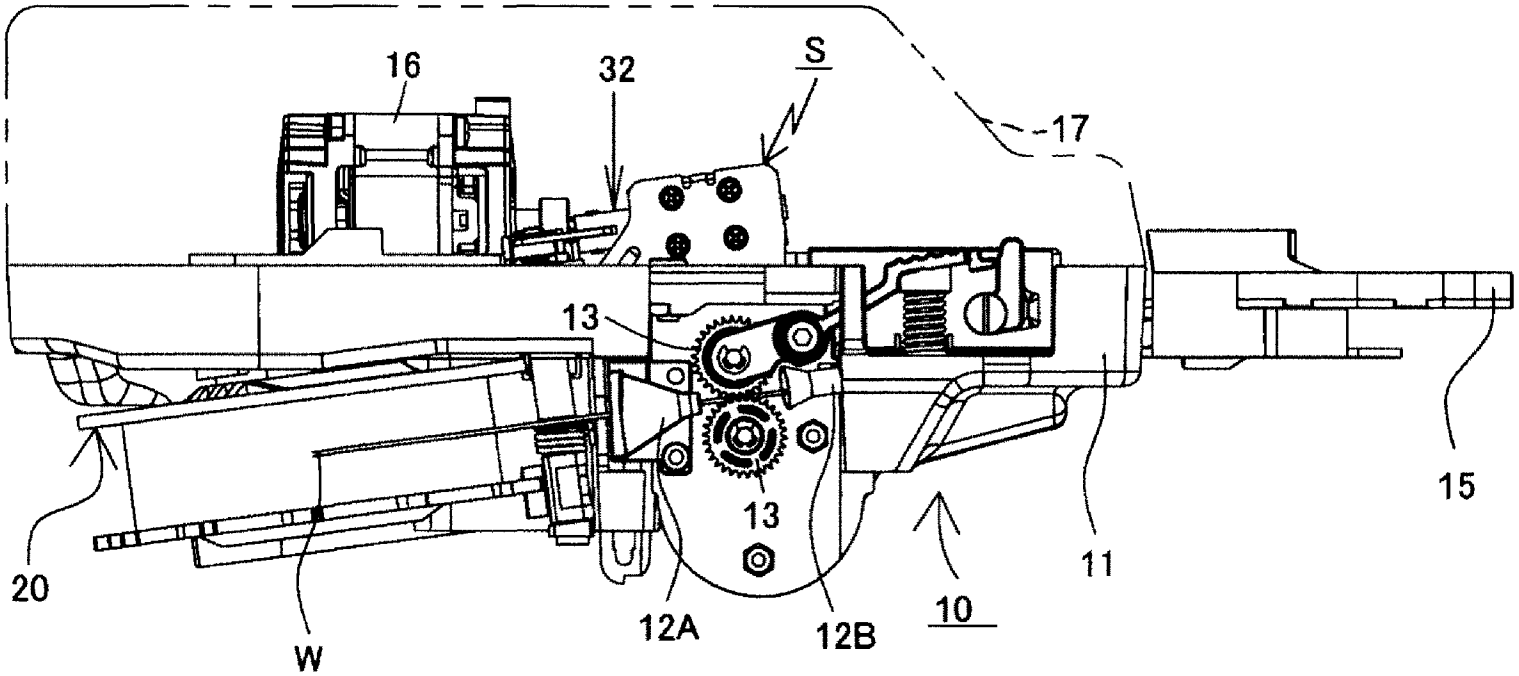
FIG. 2 is a plan view of the reinforcing bar binding machine shown in FIG. 1.
Figure 3:
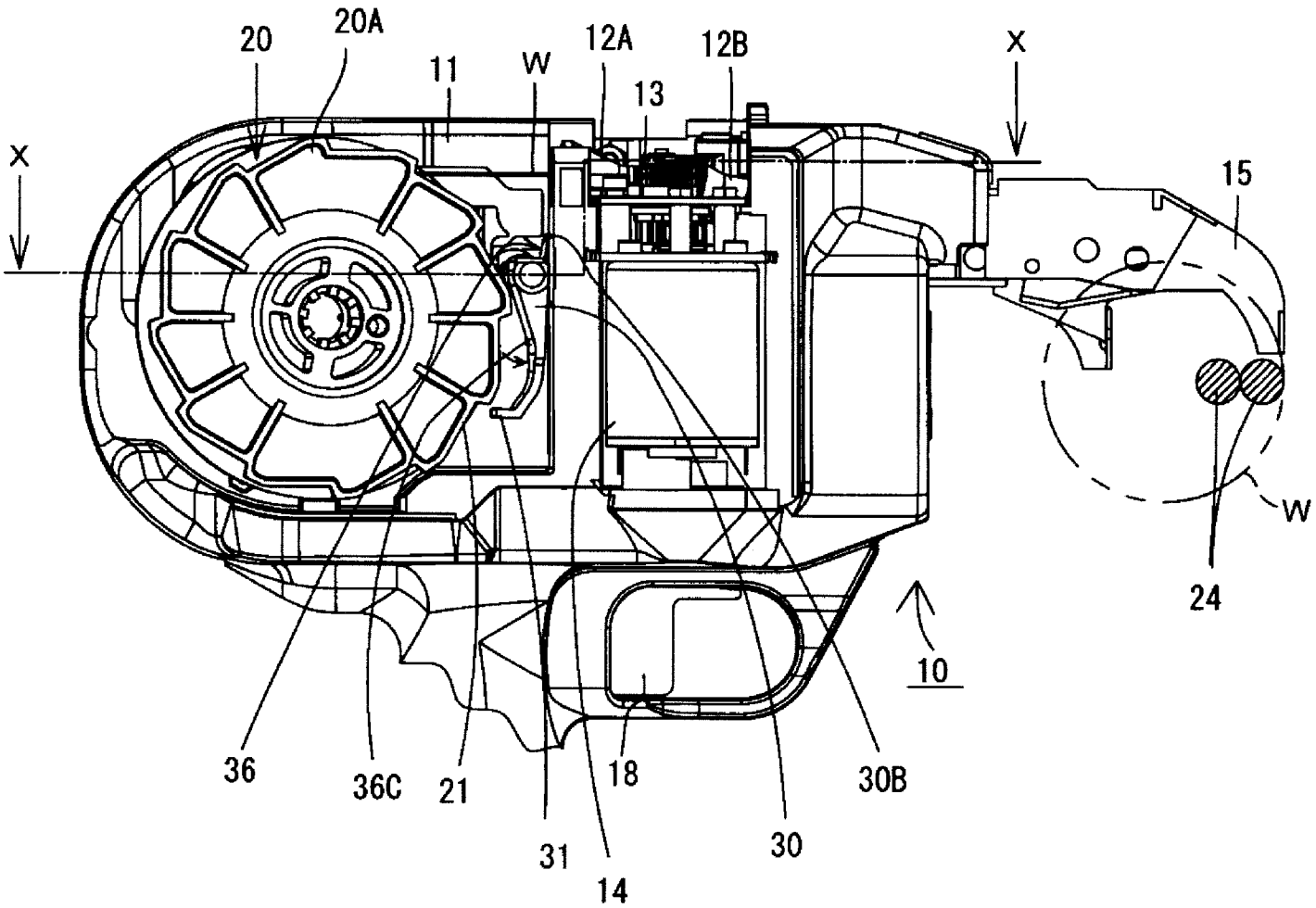
FIG. 3 is a side view shown in FIG. 1.
Figure 4:
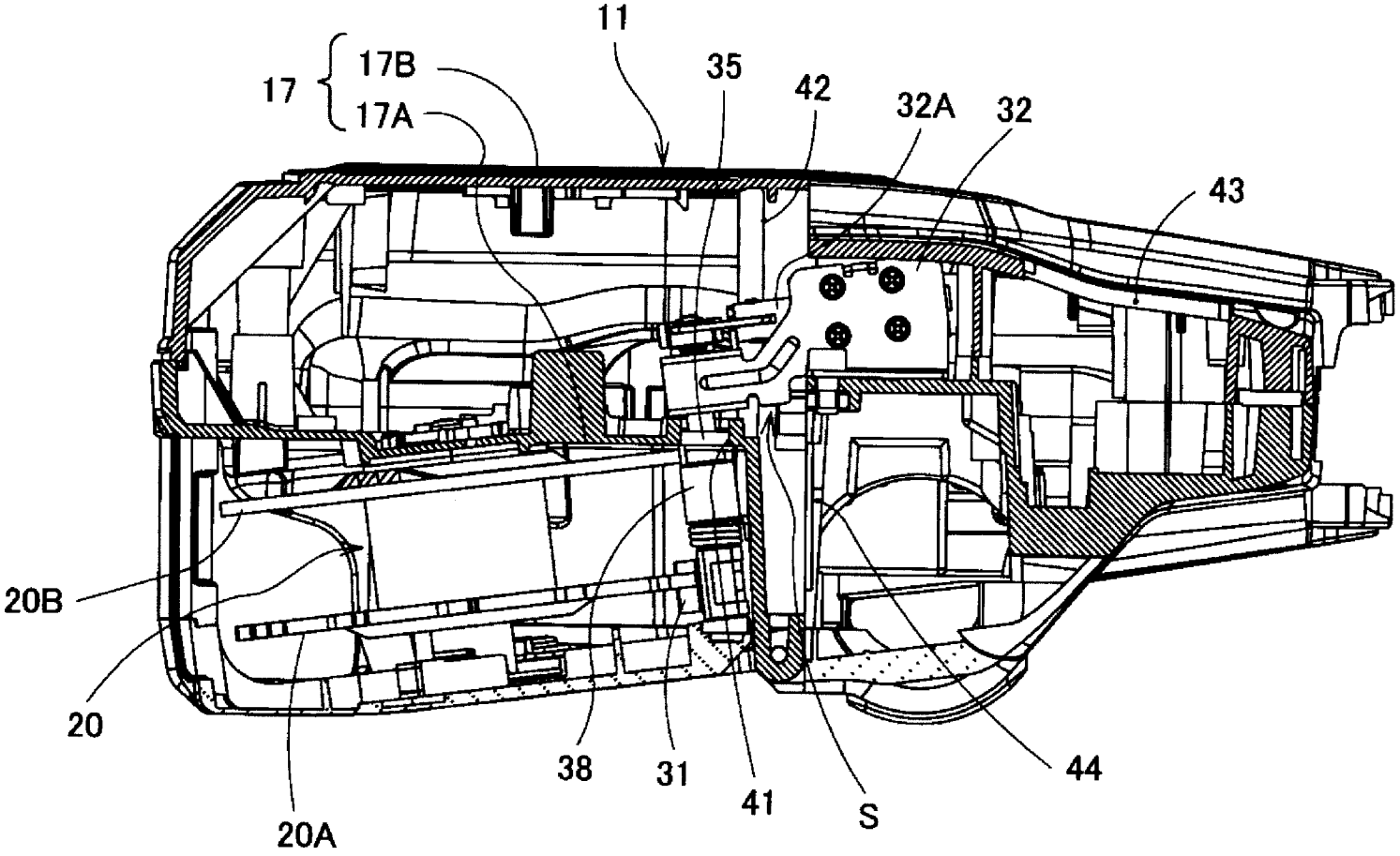
FIG. 4 is a cross-section view of X-X line in FIG. 3.
Figure 5:
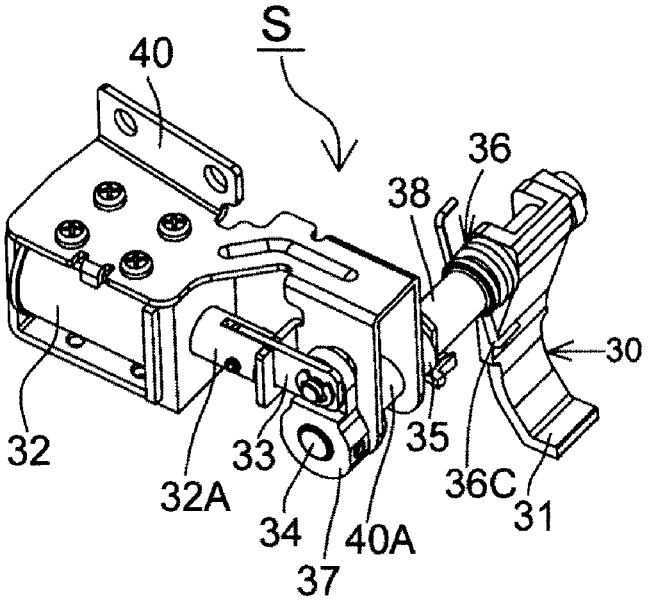
FIG. 5 is a whole perspective view of the brake mechanism shown in FIG. 4.
Figure 6:
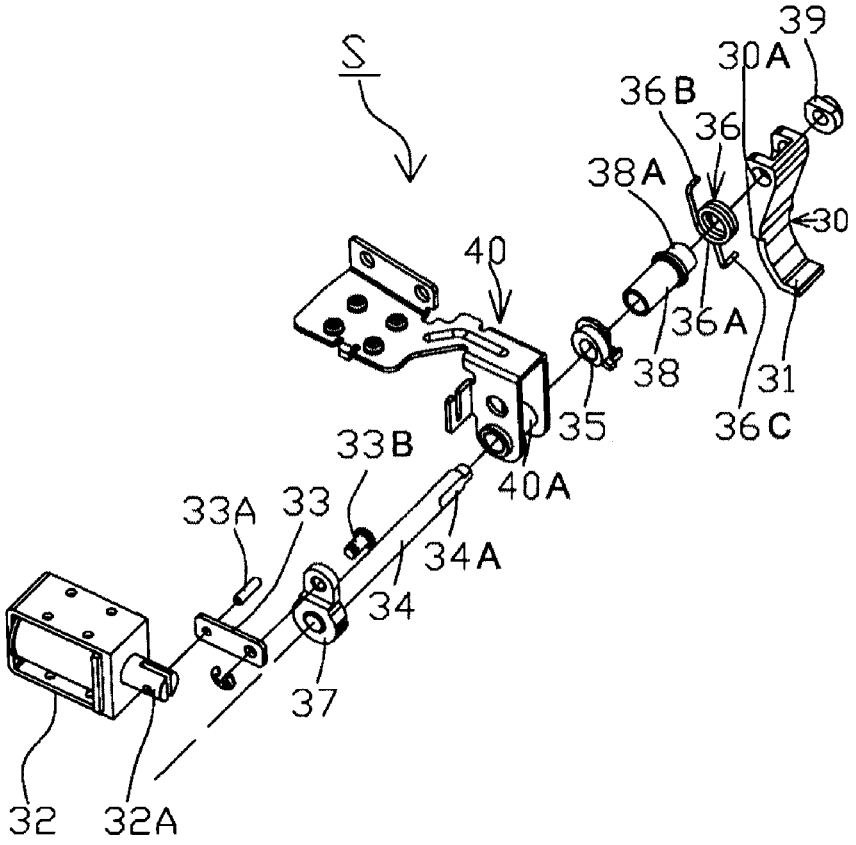
FIG. 6 is an exploded perspective view of the brake mechanism shown in FIG. 5.
Figure 11:
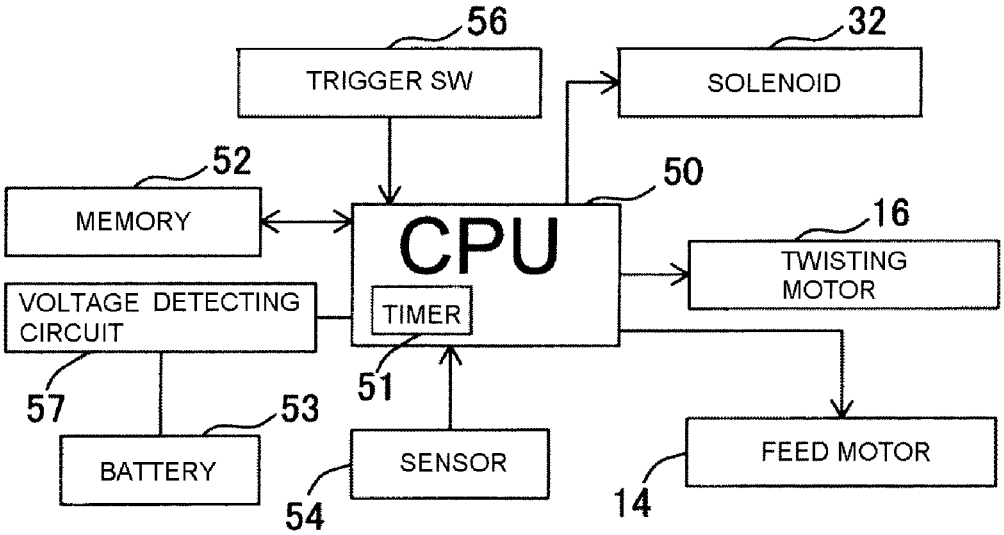
FIG. 11 is a block diagram of the reinforcing bar binding machine shown FIG. 1.

A brake mechanism of a wire reel in a reinforcing bar binding machine according to a first embodiment of the invention will be described with reference to FIGS. 1 to 8, and FIG. 11. FIG. 1 is a whole perspective view showing essential portions of a reinforcing bar binding machine in a first embodiment, FIG. 2 is a plan view of the reinforcing bar binding machine shown in FIG. 1, FIG. 3 is a side view shown in FIG. 1, FIG. 4 is a plan view of essential portions of a brake mechanism shown in FIG. 2, FIG. 5 is a whole perspective view of the brake mechanism shown in FIG. 4, and FIG. 6 is an exploded perspective view of the brake mechanism shown in FIG. 5. FIG. 11 is a block diagram of the reinforcing bar binding machine shown FIG. 1.

(Schematic Configuration of Reinforcing Bar Binding Machine)

As shown FIGS. 1 to 3, the reinforcing bar binding machine 10 includes a binding machine body 11, and a wire reel 20 detachably arranged to the binding machine body 11. The wire reel 20 is configured so as to be attached and detached only by operating a lever (not shown). Passages 12A and 12B (refer to FIGS. 2 and 3) of the binding wire W is arranged in the binding machine body 11. As shown in FIG. 2, a pair of feed gears 13 which constitutes a portion of a feed means is arranged between the passages 12A and 12B so that a wire W can be pinched therebetween. As shown in FIG. 3, a feed motor 14 which rotates feed gears 13 is arranged in the binding machine body 11. In addition, a trigger 18 (refer to FIG. 3) is arranged in the binding machine body 11, and the trigger 18 is pulled whereby the feed motor 14 is driven.

A guide 15 which guides the wire W (shown by a two-dot chain line in FIG. 3) in a loop shape so as to bend the wire is arranged on the side of a feed direction (right in FIG. 3) of the binding machine body 11. Additionally, a twisting motor 16 is arranged in the binding machine body 11, and a twisting hook (not shown) is connected to the twisting motor 16. The twisting hook is driven as the twisting motor 16 rotates, and twists a looped wire W wound around a plurality of (two in FIG. 3) reinforcing bars 24.

That is, the twisting hook is configured so as to rotate normally and advance to the looped wire W to twist the wire, and to rotate reversely after the twisting is ended, and retreat to its initial position. Additionally, the wire W which has been subjected to twisting processing is cut by a cutter (not shown) which interlocks with the twisting hook (not shown).

(Configuration of Brake Mechanism)

As shown in FIG. 4, the wire reel 20 includes a pair of flanges 20A and 20B. A plurality of substantially saw-toothed engaging portions 21 (refer to FIG. 3) is formed at predetermined intervals in one flange 20A. A stopper lever 30 that is a braking means is arranged so as to correspond to the engaging portions 21. As shown in FIG. 5, a brake system S including the stopper lever 30 include a solenoid 32 as the driving means, a link 33, a shaft 34, a connecting wheel 37, a torsion coil spring (hereinafter referred to as a spring) 36, a hollow pin 38, and a bracket 40. The bracket 40 fixes the solenoid 32, and supports the shaft 34. As shown in a two-dot chain line of FIG. 2 and FIG. 4, the bracket 40 is arranged in the cover 17 that is a dust-proofing means of the binding machine body 11.

As shown in FIG. 5, an iron core 32A of the solenoid 32 is slidably arranged, and when the solenoid 32 is turned on, the iron core 32A is pulled into the solenoid 32 (refer to FIG. 7) by a length L. In addition, the iron core 32A when the solenoid 32 is turned off is held in its initial position shown in FIG. 4. Switching of turn-on/off of the solenoid 32 is controlled by a CPU 50 shown in FIG. 11.

As shown in FIG. 6, one ends of the iron core 32A and the link 33 are connected together via a pin 33A or the like. Meanwhile, the other end of the link 33 which constitutes a link mechanism and the connecting wheel 37 fixed to the shaft 34 are connected together via a pin 33B, and the shaft 34 is rotatably arranged in the bracket 40 via the connecting wheel 37. Additionally, the shaft 34 is inserted through a tubular portion 40A of the bracket 40. When the iron core 32A and the link 33 slide, the shaft 34 rotates around its axis. In addition, the shaft 34 has a D-shaped cut portion 34A, which is cut in a D-shape, at its tip.

The shaft 34 which protrudes from the tubular portion 40A of the bracket 40 is inserted into a bearing 35, a hollow pin 38, a coil portion 36A of the spring 36, and the D-shaped cut hole 30A of the stopper lever 30. The stopper lever 30 or the like is prevented from slipping out of the shaft 34 by a stopper 39.

The D-shaped cut portion 34A of the shaft 34 corresponds to the hole 30A of the stopper lever 30, and as the shaft 34 rotates, the stopper lever 30 rotates about the shaft 34. A locking portion 31 which engages an engaging portion 21 of the wire reel 20 is formed in a substantial L shape (refer to FIG. 3) in the stopper lever 30.

The solenoid 32, the shaft 34, and bracket 40 which are shown in FIG. 6 are arranged within the cover 17 shown in FIG. 2 and FIG. 4. That is, the cover 17 is configured by a body cover 17A for covering one side of the binding machine body 1 and a body cover 17B for covering the other side. A space between the body cover 17A and the body cover 17B is substantially hermetically-sealed. The bearing 35 of the shaft 34 is fit and fixed to an opening portion 41, and other members (not shown) are fit to opening portions 42, 43, 44. Thus, a portion between the solenoid 32 and the wire reel 20 is partitioned by the cover 17, and the solenoid 32 and the tubular portion 40A of the bracket 40 is concealed from the wire reel 20. Additionally, although the tubular portion 40A of the bracket 40 in sliding portions of the shaft 34 which rotates the stopper lever 30 is arranged in an inside of the cover 17 and concealed from an outside, a portion of the sliding portions of the shaft 34 arranged in an outside also concealed by the hollow pin 38 and the bearing 35.

As shown in FIG. 6, a coil portion 36A of the spring 36 is inserted into a coil receptacle 38A of the hollow pin 38, and the spring 36 is supported by the hollow pin 38. As shown in FIG. 3, a hooking portion 36B of the spring 36 is locked to the binding machine body 11, and a hooking portion 36C is locked to the outside of the stopper lever 30 (refer to FIG. 5). Therefore, the spring 36 always biases the stopper lever 30 in the direction (that is, counterclockwise direction) of an arrow shown in FIG. 3.

That is, in the stopper device S, the link mechanism is interposed between the stopper lever 30, and the solenoid 32 which operates the stopper lever 30. Thus, time lag until the brake is actuated becomes larger than that of FIG. 3 of the aforementioned Patent Document 1. In addition, a state at the time of a waiting mode in the stopper device S, i.e., OFF of the solenoid 32 is a state shown in FIGS. 1 to 5.

(Configuration Concerning Control System of Reinforcing Bar Binding Machine)

The reinforcing bar binding machine 10, as shown in FIG. 11, includes a CPU 50 which also has a clock function, a memory 52, a battery 53, a sensor 54, a trigger SW 56 (SW is the abbreviation for switch), a voltage detecting circuit 57, the solenoid 32, the twisting motor 16, and the feed motor 14. The CPU 50 manages overall operation of the reinforcing bar binding machine 10. For example, when a switch signal is input to the CPU 50 from the trigger SW 56, the CPU performs binding processing on the basis of the switch signal. Additionally, as described above, the CPU 50 includes a timer 51 which performs clocking. In addition, the CPU 50 is a control means and a counting means.

Programs which control various kinds of processing for the reinforcing bar binding machine 10 are recorded in the memory 52 that is a recording means. For example, the turn-on time or the like of the solenoid 32 is recorded in the memory 52. The sensor 54 is arranged so as to be capable of detecting the rotation of the feed gears 13. That is, a magnet which rotates together with the feed gears 13 is detected by a Hall IC that is the sensor 54. The sensor 54 detects that the feed gears 13 has half-rotated, and the CPU 50 determines whether or not the wire W has been fed by a predetermined length, for example, 80 cm per one rotation on the basis of a detection signal of the sensor 54 with the number of rotation of the feed gears 13.

The battery 53 is a power source of the CPU 50, the solenoid 32, the twisting motor 16, the feed motor 14, and the like, and supplies electric power which starts the solenoid 32, the CPU 50, and the like. Additionally, the voltage detecting circuit 57 that is a voltage detecting means detects the voltage of the battery 53, and inputs to the CPU 50 detection value data that is this detection result. Also, the CPU 50 compares a power voltage of the battery 53 which is input detection value data with a reference voltage recorded in the memory 52. In addition, as for wiring lines of the battery 53, illustration of those other than the voltage detecting circuit 57 is omitted. This is to prevent complication in a case where a plurality of wiring lines is connected to respective electronic components, such as the CPU 50.

The trigger SW 56 interlocks with the pulling of the trigger 18 shown in FIG. 3, and is configured so that the switch is turned on. When the trigger SW 56 is turned on, the CPU 50 makes the feed motor 14, i.e., the feed gears 13 rotate, thereby pulling out the wire W in a feed direction. That is, the feed motor 14 and the twisting motor 16 are rotationally driven on the basis of a driving signal from the CPU 50. In addition, the twisting motor 16 is adapted to be normally and reversely rotatable.

Additionally, the solenoid 32 makes the iron core 32 slide in a pulling-in direction from its initial position (position shown in FIG. 4) on the basis of the driving signal (that is, ON signal) from the CPU 50. When any driving signal is not supplied from the CPU 50, the solenoid 32 is brought into an OFF state, and the stopper lever 30 shown in FIG. 5 returns to its initial position (position shown in FIG. 3) by the biasing force of the spring 36.

(Operation of this Embodiment

When the trigger 18 of the reinforcing bar binding machine 10 shown in FIG. 3 is pulled and operated, the wire W wound around the wire reel 20 is fed by a predetermined length by the feed gears 13, and is wound around a plurality of reinforcing bars 24. Then, immediately before feed operation of the wire W ends, the solenoid 32 is turned on, and the iron core 32A is pulled in. By this pulling-in operation, the stopper lever 30 rotates in the direction of an arrow (clockwise direction) of FIG. 8 against the biasing force of the spring 36.

Figure 7:
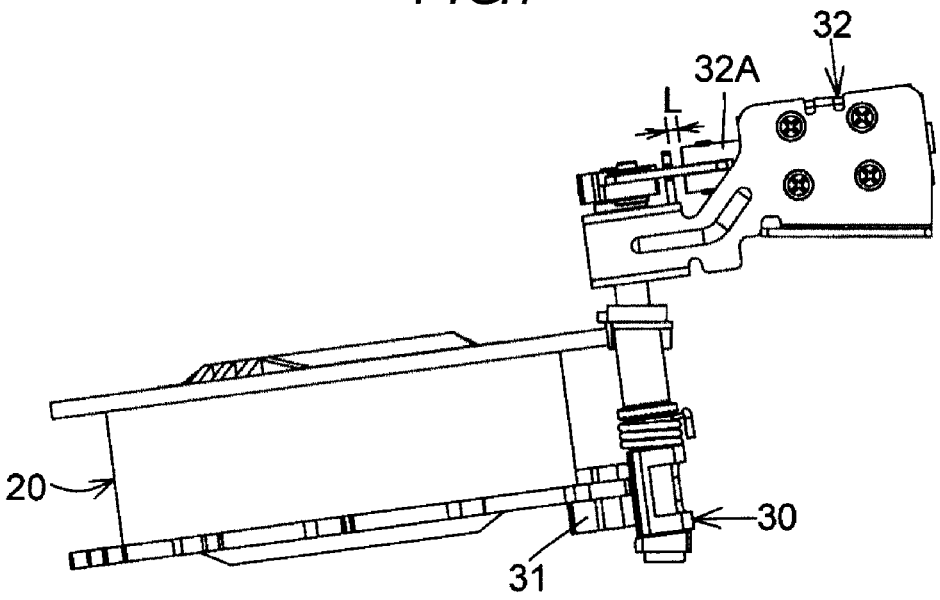
FIG. 7 is a plan view of essential portions at the time of braking operation of the brake mechanism shown in FIG. 4.
Figure 8:
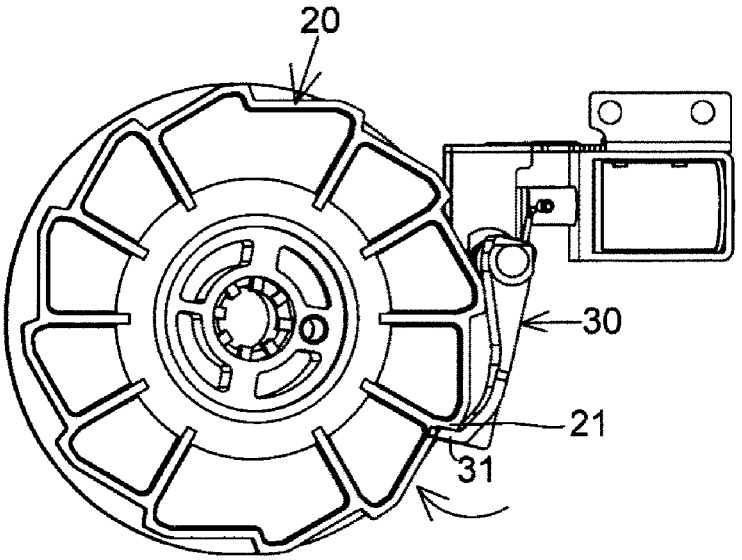
FIG. 8 is a side view of FIG. 7.

Therefore, as shown in FIG. 8, the locking portion 31 of the stopper lever 30 is engaged with an engaging portion 21 of the wire reel 20, and stops the rotation of the wire reel 20. Accordingly, since the wire reel 20 does not rotate by inertia, the diameter of the wire W does not increase, and the wire W can always be fed smoothly. FIG. 7 is a plan view of essential portions at the time of braking operation of the brake mechanism shown in FIG. 4, and FIG. 8 is a side view of FIG. 7.

After the lapse of predetermined time, the solenoid 32 is turned off, and the stopper lever 30 rotates in the direction (counterclockwise direction) of the arrow of FIG. 3 by the biasing force of the spring 36, and the iron core 32A also slides to its initial position (refer to FIG. 4). That is, since the spring 36 is directly hung on the stopper lever 30, the stopper lever 30 can be directly returned to its initial state by the biasing force of the spring 36. Accordingly, since there is no waste in the biasing force of the spring, and an unnecessary force is not applied to each part, for example, the iron core 32A or the like, the stopper lever 30 can be returned efficiently.

Thereafter, the twisting motor 16, i.e., the twisting hook is driven on the basis of the driving signal of the CPU 50, and the wire W is twisted and bound. In addition, the CPU 50 outputs the driving signal to the twisting motor 16 after the feed operation of the wire W is ended.

Next, the processing concerning the aforementioned binding processing (the same as a binding mode) will be described with reference to the flow chart shown in FIG. 12. Here, the processing in the reinforcing bar binding machine 10 shown in FIG. 1 is executed by the CPU 50 (refer to FIG. 11), and is expressed by the flow chart of FIG. 12. This program is stored in advance in a program area of the memory 52 (refer to FIG. 11) of the reinforcing bar binding machine 10. In addition, FIG. 13 is a view showing the operating timing of the solenoid 32 shown in FIG. 1.

(Binding Mode)

Figure 12:
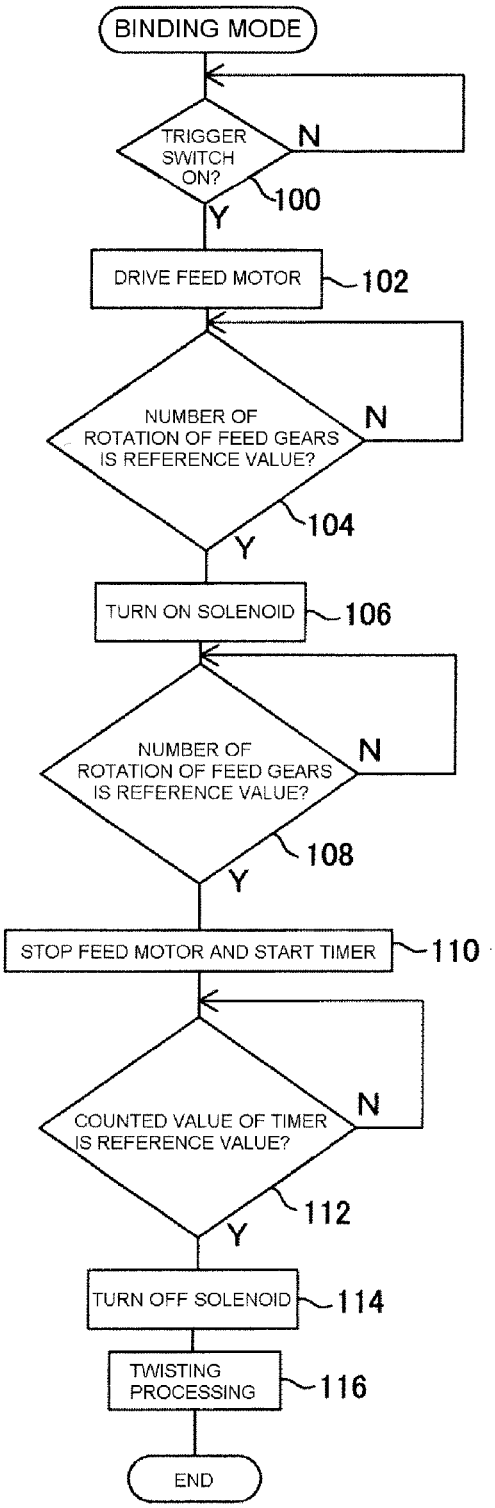
FIG. 12 is a flow chart in a binding mode of the reinforcing bar binding machine shown in FIG. 1.
Figure 13:
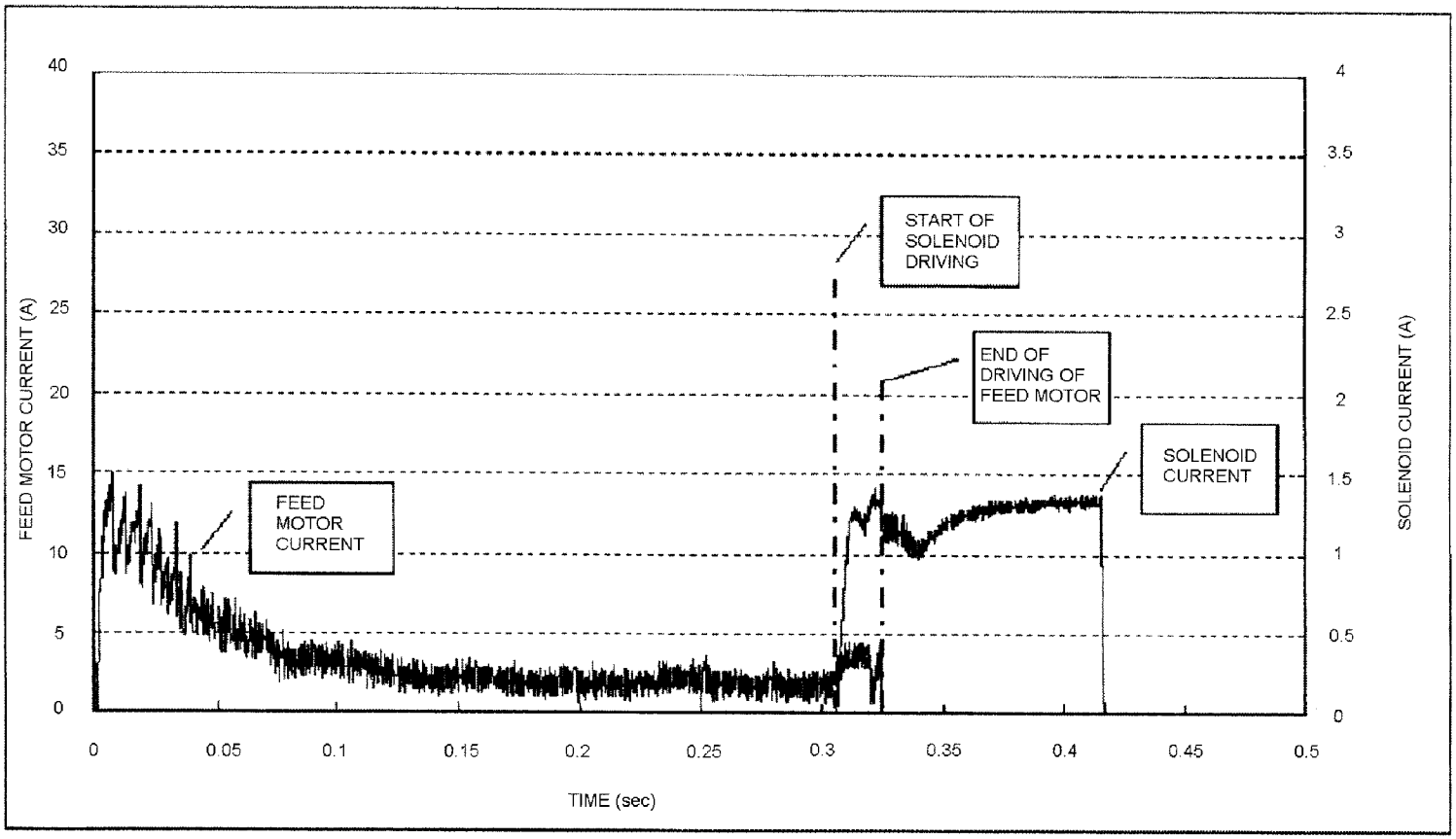
FIG. 13 is a view showing the operating timing of a solenoid shown in FIG. 1.

In Step 100 shown in FIG. 12, it is determined whether or not the trigger SW 56 (refer to FIG. 11) is turned on. That is, the trigger 18 shown in FIG. 3 is pulled, and it is determined whether or not the trigger SW 56 is turned. If Step 100 is positive, i.e., if the trigger SW 56 is turned on, the CPU 50 makes the feed motor 14 driven in Step 102. In addition, if Step 100 is negative, the CPU waits for the trigger SW 56 to be turned on.

In Step 104, it is determined whether or not the number of rotation of the feed gears 13 shown in FIG. 2 has become a reference value (the same as a "predetermined amount of feed before a predetermined length"). Here, the reference value is a reference number of rotation which is used to determine whether or not the feed gears 13 have a number of rotation at which they feed the wire W to a predetermined feed amount before a predetermined length.

That is, as the rotation of the feed gears 13 is detected by the sensor 54 shown in FIG. 11, the CPU 50 determines whether or not the feed gears 13 have rotates by the reference value, for example, seventeen times. If Step 104 is positive, i.e. if the number of rotation of the feed gears 13 has reached the reference number of rotation, the solenoid 32 shown in FIG. 11 is turned on in Step 106. In addition, if Step 104 is negative, the CPU waits for the number of rotation of the feed gears 13 to reach the reference number of rotation.

In Step 108, it is determined whether or not the number of rotation of the feed gears 13 has become the reference value (for example, seventeen and half rotations). Here, the reference value is a reference number of rotation which is used to determine whether or not the feed gears 13 have a number of rotation at which they feed the wire W by a predetermined length. That is, it is determined in Step 108 whether or not the feed gears has half-rotated from the reference rotation (17 rotations) of Step 104.

If Step 108 is positive, i.e. if the number of rotation of the feed gears 13 has reached the reference number of rotation, in Step 110, the CPU 50 stops the feed motor 14, and starts counting of clock in the timer 51 shown in FIG. 11. Here, turn-on of the solenoid 32 immediately before wire feed is performed taking into consideration time lag until braking is applied to the wire reel 20 through actuation of the solenoid 32. In addition, if Step 108 is negative, the CPU waits for the number of rotation of the feed gears 13 to reach the reference number of rotation.

In Step 112, the CPU 50 determines whether or not the counted value of the timer 51 has become the reference value (refer to FIG. 11) of braking release time, for example, 0.1 second. If Step 112 is positive, i.e. if the counted value has become the braking release time (the counted value is 0.1 second), the solenoid 32 is turned off in Step 114.

In addition, if Step 112 is negative, the CPU waits for the counted value to become reference time. Here, the reason why braking is applied to the wire reel 20 for 0.1 second is because this time is braking release time required for reliably stopping the rotation of the wire reel 20 experimentally. In addition, this braking release time can be arbitrarily changed to 0.08 second, 0.12 second, or the like by change of the configuration of the link mechanism of the stopper device S.

In Step S116, twisting processing is performed. The twisting processing is the processing of normally rotating the twisting motor 16, and twisting the wire W (refer to two-dot chain line of FIG. 3) wound around a plurality of intersecting reinforcing bars 24 (refer to FIG. 3) by the twisting hook (not shown), and the processing of reversely rotating the twisting motor 16, and returning the twisting hook to its initial position. If the processing of Step 116 is ended, processing of this flow chart is ended. In addition, the binding mode shown in FIG. 12 is repeated whenever the trigger SW 56 is turned on.

According to this embodiment, since braking of the rotation of the wire reel 20 is started by the stopper device S after the wire W is fed by a predetermined amount of feed (reference number of rotation of Step 104) before a predetermined length by the feed gears 13, the time lag when braking is applied to the wire reel 20 can be reduced, and braking performance improves.

In addition, the processing concerning the power saving mode and braking timing change mode in the reinforcing bar binding machine 10 will be described below with reference to the flow chart shown in FIGS. 14 and 15.

(Power Saving Mode)

Figure 14:
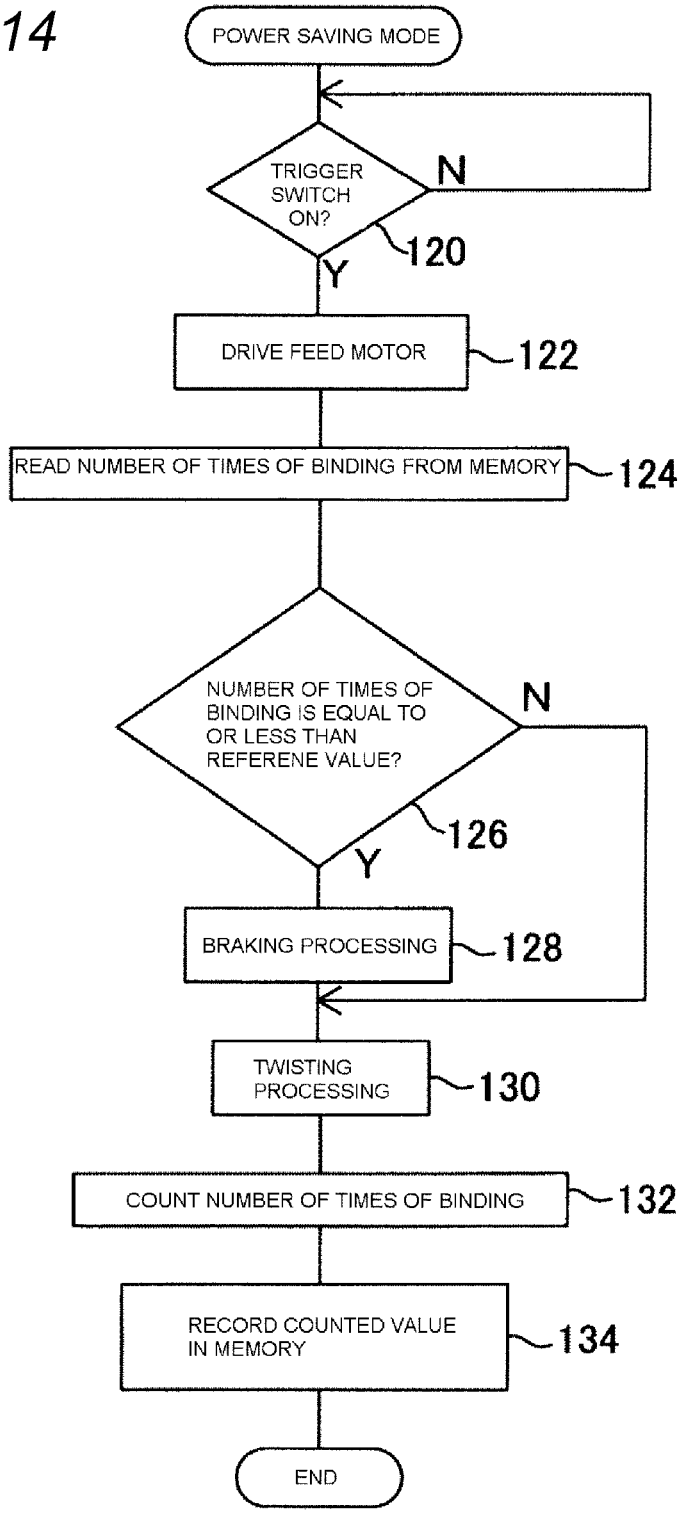
FIG. 14 is a flow chart of a power saving mode of the reinforcing bar binding machine shown in FIG. 1.

In Step 120 shown in FIG. 14, it is determined whether or not the trigger SW 56 is turned on. If Step 100 is positive, i.e., if the trigger 18 is pulled, the CPU 50 makes the feed motor 14 driven in Step 122. In Step 124, the number of times of binding is read from the memory 52 shown in FIG. 11. Here, with regard to counting of the number of times of binding, the CPU 50 that is a counting means resets the counted value of the number of times of binding in a storage region of the memory 52, and starts counting whenever the wire reel 20 shown in FIG. 1 is mounted on the binding machine body 11. In addition, generally, the wire W wound around the wire reel 20 is able to perform binding processing of 120 times.

In Step 126, it is determined whether or not the number of times of binding is equal to or less than a reference value. That is, the CPU 50 determines whether or not the reference value, for example, the counting value, is equal to or less than 40 times. If Step 126 is positive, i.e., if the counted value is equal to or less than 40 times, the CPU 50 performs braking processing in Step 128. This braking processing is respective processing of Step 104 to Step 114 shown in FIG. 12.

After braking processing of Step 128 is ended, the same processing as twisting processing (the same processing as Step 116 of FIG. 12) is performed in Step 130. If Step 126 is negative, i.e. if the counted value is 40 times or more, the processing proceeds to Step 130. That is, if Step 126 is negative, braking processing of Step 128 is omitted. Here, the reason why braking processing is performed if the counting number is less than 40 times is because the difference between the maximum winding diameter of the wire W and the diameter of the outer peripheries of the flanges 20A and 20B of the wire reel 20 is small, and thus, when the wire reel 20 rotates by inertia, the wire W protrudes from the flanges 20A and 20B, and the next wire feed is hindered.

On the other hand, the reason why braking processing is omitted if the counted value is 40 times or more because the diameter difference between the maximum winding diameter of the wire W and the diameter of the outer peripheries of the flanges 20A and 20B of the wire reel 20 is large, and thus, even when the wire reel 20 rotates by inertia, the wire W does not protrudes from the flanges 20A and 20B.

After twisting processing of Step 130 is ended, the number of times of binding is counted in Step 132. That is, the CPU 50 performs increment of 1 to a current counted value, for example, 20, thereby setting the counter value to 21. Then, in Step 134, the counted value, for example, 21 is stored in the memory 52. In addition, this recorded counted value is read in the next Step 124. If the processing of Step 134 is ended, processing of this flowchart is ended. The power saving mode shown in FIG. 14 is repeated whenever the trigger SW 56 is turned on.

In this embodiment, only if the number of times of binding by which the wire W fed by a predetermined length by the feed gears 13 is twisted and bound is equal to or less than a reference value (specifically, if Step 126 is positive), braking is applied to the wire reel 20 by the stopper device S. That is, according to this embodiment, if the number of times of binding of a predetermined length of wire W is a reference value or more (specifically, if Step 126 is negative), braking processing is omitted, and thus, power is saved. Thus, the service time of the battery 53 shown in FIG. 11 is extended, and the battery 53 can be effectively used for a long time.

(Braking Timing Change Mode)

Figure 15:
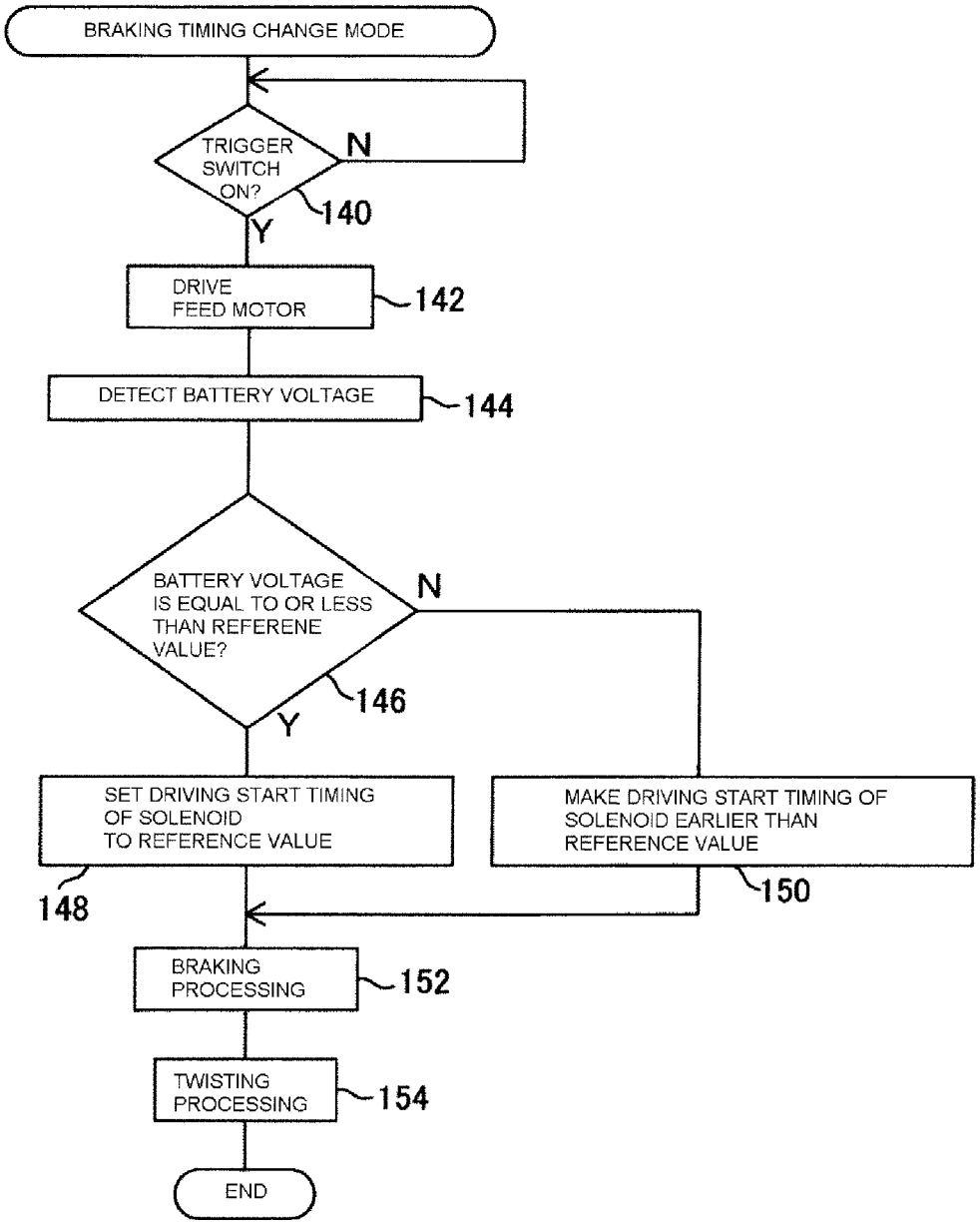
FIG. 15 is a flow chart of a braking timing change mode of the reinforcing bar binding machine shown in FIG. 1.

In Step 140 shown in FIG. 15, it is determined whether or not the trigger SW 56 is turned on. If Step 140 is positive, i.e., if the trigger 18 is pulled, the CPU 50 makes the feed motor 14 driven in Step 142. In Step 144, CPU 50 detects the voltage value of the battery 53 via the voltage detecting circuit 57 shown in FIG. 11. That is, the CPU 50 reads voltage value data input from the voltage detecting circuit 57. Here, the battery voltage is set to, for example, 16 V if the battery is fully charged (i.e. the same as a maximum voltage), and a minimum voltage (i.e., voltage immediately before a power source is turned off) is set to, for example, 14.4 V. The memory 52 shown in FIG. 11 stores the reference value of the battery voltage in its storage region as, for example, 15 V.

In Step 146, it is determined whether or not the voltage value of the battery is equal to or less than a reference value. That is, the CPU 50 determines whether or not the battery voltage is equal to or less than 15 V. If Step 146 is positive, i.e., if the battery voltage value is equal to or less than 15 V), in Step 148, CPU 50 set the driving start timing (the same as braking start timing) of the solenoid 32 shown in FIG. 11 to the reference value, for example, the reference rotation (17 rotations) in the Step 104. That is, the solenoid 32 is driven by 17 rotations, and braking is applied.

If Step 146 is negative, i.e. if the battery voltage is 15 V or more, in Step 150, the driving start timing of the solenoid 32 is made earlier than the reference rotation (17 rotations). For example, in order to make the braking start time of the stopper device S earlier than the reference time, the solenoid 32 is driven with sixteen and half rotations as the reference value, and braking is applied.

Here, the reason why the processing of Step 150 is provided is because the feed rate of the wire W becomes fast if the battery voltage is higher than the reference value, and thus, it is necessary to bring forward the timing with which braking is applied to the wire reel 20. In this case, since termination of an electric current flowing through the solenoid 32 is made the same as that of an example shown in FIG. 11, the turn-on time of the solenoid 32 becomes long consequently.

On the other hand, if the battery voltage is lower than the reference value, the feed rate of the wire W returns to a normal state (the same as standard). Thus, the termination of the electric current is made the same as that of the example of FIG. 10. That is, since the turn-on time of the solenoid 32 becomes shorter than that of Step 150, power is saved. Accordingly, since the timing with which braking is applied is changed according to the battery voltage, the inertial rotation of the wire reel 20 can be stopped reliably, and useless power consumption can be cut.

After processing of Step 150 or Step 148 is ended, braking processing is performed in Step 152. This braking processing is respective processing of Step 104 to Step 114 shown in FIG. 12. After braking processing of Step 152 is ended, the same processing as twisting processing (the same processing as Step 116 of FIG. 10) is performed in Step 154. If the twisting processing of Step 154 is ended, processing of this flow chart is ended. In addition, the braking timing change mode shown in FIG. 13 is repeated whenever the trigger SW 56 is turned on.

In this embodiment, if the power voltage of the battery 53 is a predetermined reference value or more (if Step 146 is negative), the feed rate of the wire W becomes fast. Thus, if the timing with which braking is applied to the wire reel 20 is not made earlier by the rate which becomes fast, the timing with which braking is applied becomes late on the contrary.

That is, according to this embodiment, only if the power voltage of the battery 53 is a predetermined reference value or more, the braking start time of the stopper device S which stops the rotation of the wire reel 20 is made earlier than the reference time. Thus, braking is applied with proper timing, and braking performance improves.

On the other hand, in this embodiment, if the battery voltage is lower than the reference value (if Step 146 is positive), the feed rate of the wire W returns to a normal state. Thus, since the turn-on time of the solenoid 32 becomes shorter than Step 150. Thus, power is saved. That is, according to this embodiment, since the timing with which braking is applied is changed according to the battery voltage, the inertial rotation of the wire reel 20 can be stopped reliably, and useless power consumption can be cut.

In addition, the source of power which drives the stopper lever 30 may be a motor or the like other than the solenoid 32. Additionally, the reference value (refer to Step 104) of the predetermined amount of feed in claim 1 or 2, for example, the number of rotation of the feed gears 13 can be arbitrarily set and changed by changing the configuration of the link mechanism which is interposed between the stopper lever 30 and its driving source.

Additionally, the flow (refer to FIGS. 12, 14, and 15) of processing of each program described in the above embodiment is merely an example, and can be suitably changed without departing the spirit or scope of this invention. That is, the binding mode, the power saving mode, or the braking timing change mode may be combined arbitrarily.

In this embodiment, the solenoid 32, a part of the shaft 34 for rotating the stopper lever 30, and the bracket 40, which are shown in FIG. 6, are arranged within the cover 17 shown in FIG. 2 and FIG. 4, and a sliding portion of the shaft 34 has become the insides of the tubular portion 40A of the bracket 40, the bearing 35, and the hollow pin 38. Thus, the solenoid 32 and shaft 34 which rotate the stopper lever 30 are altogether covered and concealed with the cover 17 or the like.

That is, according to this embodiment, the portion between the solenoid 32 and the wire reel is partitioned by the cover 17 and the solenoid 32 is concealed. Thus, even if the reinforcing bar binding machine 10 is used outdoors or the like, braking operation can be reliably performed without adhesion of sand or the like to the solenoid 32. Accordingly, the loading property of the wire reel is not impaired. In addition, the part of the sliding portion of the shaft 34 positioning in the outer side of the cover 17 is also concealed by the hollow pin 38, the bearing 35 and the like. Therefore, dust-proofing performance improves, so that adhesion of sand or the like to the sliding portion can be prevented and the braking operation can be further reliably performed. Particularly, the bearing 35 is adjacent to the hollow pin 38 and a part of the shaft 34 positioning in an outer side of the bearing 35 is covered by the hollow pin 38, the adhesion of sand or the like to the bearing 35 can further be prevented.

Further, the sliding portion is a portion which is arranged to cover around the shaft 34 and slides, and the sliding portion is not limited to the tubular portion 40A of the bracket 40 and the bearing 35 or the hollow pin 38.

Second Embodiment

Figure 9:
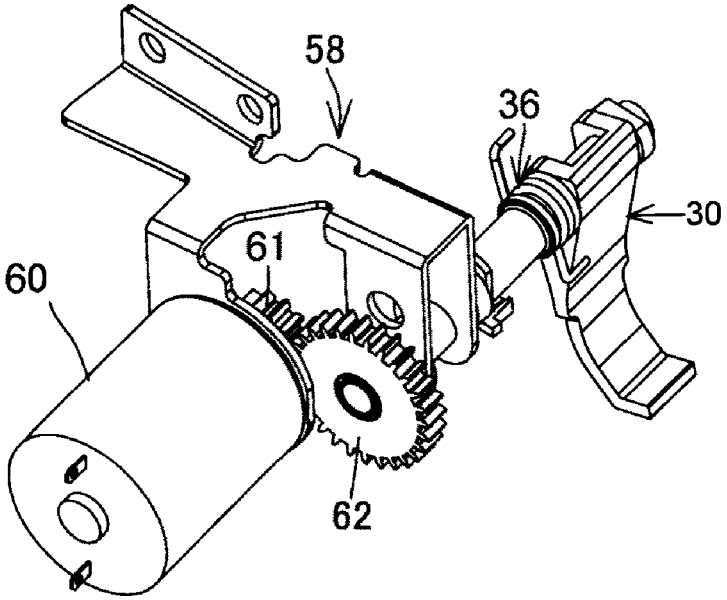
FIG. 9 is a whole perspective view of a brake mechanism in a second embodiment related to the invention.
Figure 10:
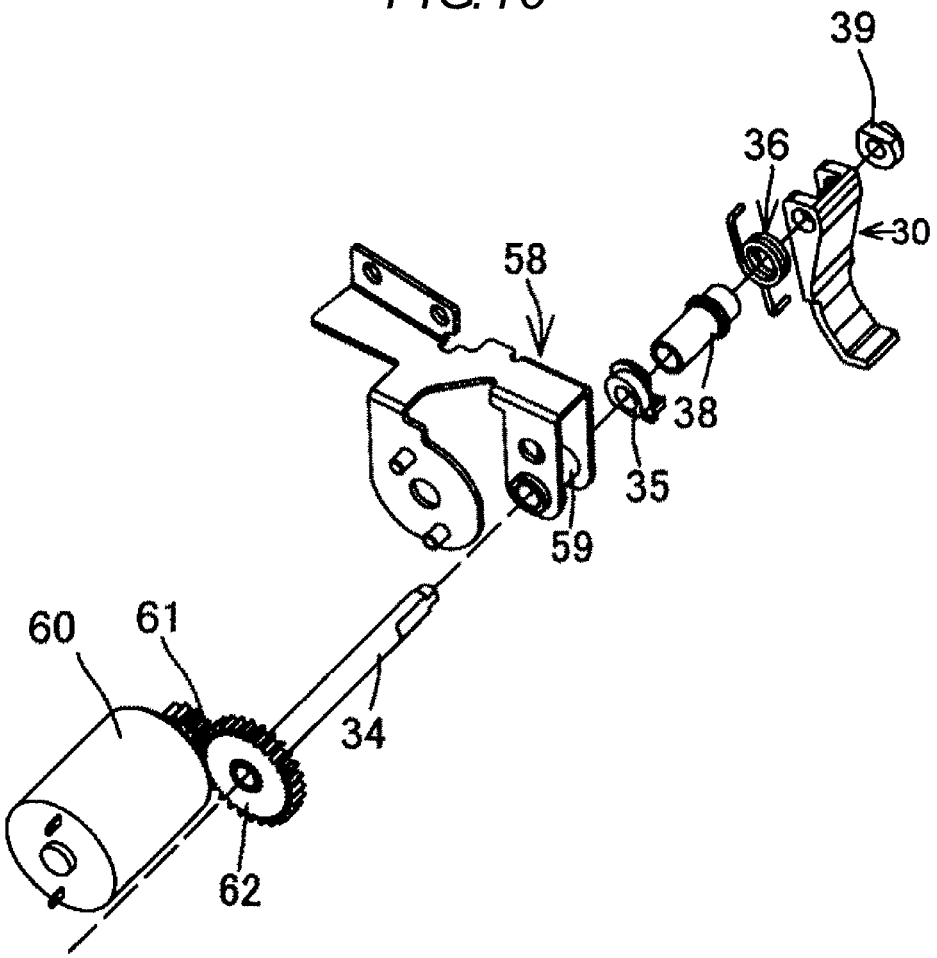
FIG. 10 is an exploded perspective view of the brake mechanism shown in FIG. 9.

A second embodiment in which the driving means is changed to an exclusive motor capable of performing normal rotation from a solenoid will be described below with reference to FIGS. 9 and 10. Here, FIG. 9 is a whole perspective view of a brake mechanism in the second embodiment, and FIG. 10 is an exploded perspective view of the brake mechanism shown in FIG. 9. In addition, the same parts as those of the first embodiment are denoted by the same reference numerals. Additionally, FIG. 9 corresponds to FIG. 5 in the first embodiment, and FIG. 10 corresponds to FIG. 6 in the first embodiment.

In the stopper device of this embodiment, a brake motor (hereinafter referred to as a motor) 60 is fixed to a bracket 58. A gear 61 of the motor 60 meshes with a reduction gear 62 fixed to the shaft 34. In addition, a tubular portion 59 which allows the shaft 34 to be inserted therethrough is arranged at the bracket 58. Additionally, in this embodiment, connecting parts, such as the link 33 and connecting wheel 37 which are shown in FIG. 6, are not arranged. The other configurations are the same as those of the examples of FIGS. 5 and 6. Accordingly, also in the above stopper device, a cover (not shown) partitions the motor 60 as the driving means and the wire reel 20.

According to this embodiment, since the brake lever 30 can be directly rotated by the rotation of the reduction gear 62 in the motor 60 capable of performing normal and reverse rotation, braking release becomes quick. Additionally, according to this embodiment, the spring 36 shown in FIG. 9 can be made unnecessary, and the number of parts can be reduced. Since the other operational effects are the same as those of the first embodiment, detailed description thereof is omitted.

While description has been made in connection with specific exemplary embodiment of the invention, it will be obvious to those skilled in the art that various changes and modification may be made therein without departing from the present invention. It is aimed, therefore, to cover in the appended claims all such changes and modifications falling within the true spirit and scope of the present invention.

What is claimed is:

1. A reinforcing bar binding machine comprising:

a feed device configured to feed out a wire from a wire reel rotatably mounted on a binding machine body in a feeding direction when the feed device is activated;

a brake configured to brake a rotation of the wire reel in the feeding direction; and a controller configured to start braking the rotation of the wire reel in the feeding direction by the brake upon the wire is fed out to a predetermined amount by the feed device, and to deactivate the feed device to stop feeding the wire in the feeding direction when the wire is fed out to a predetermined length which is larger than the predetermined amount of feeding in the feeding direction.

2. A reinforcing bar binding machine in which a wire is fed from a wire reel rotatably mounted on a binding machine body, the fed wire is wound around reinforcing bars, and the wound wire is twisted to bind the reinforcing bars, the reinforcing bar binding machine comprising:

a feed device configured to feed out the wire from the wire reel in a feeding direction when the feed device is activated;

a brake configured to brake a rotation of the wire reel in the feeding direction;

a counter configured to count a number of times of binding by which the fed wire is twisted to bind the reinforcing bars;

a recording device configured to record the number of times of binding; and a controller configured to start braking the rotation of the wire reel in the feeding direction by the brake upon the wire is fed out to a predetermined amount by the feed device, and to deactivate the feed device to stop feeding the wire in the feeding direction when the wire is fed out to a predetermined length which is larger than the predetermined amount of feeding in the feeding direction only in a case where the number of times of binding read from the recording device is equal to or less than a predetermined number of times of binding.

* * * * *